United States Patent [19]

Imajo

[11] Patent Number: 4,936,266

[45] Date of Patent: Jun. 26, 1990

[54] VALVE DRIVE TRAIN FOR INTERNAL COMBUSTION ENGINE

[75] Inventor: Minoru Imajo, Kanagawa, Japan

[73] Assignee: Nissan Motor Company, Limited, Japan

[21] Appl. No.: 353,772

[22] Filed: May 18, 1989

[30] Foreign Application Priority Data

May 26, 1988 [JP] Japan ..... 63-128800

[51] Int. Cl.[5] ..... F01L 1/34

[52] U.S. Cl. ..... 123/90.17; 123/90.31; 123/90.27

[58] Field of Search ..... 123/90.15, 90.17, 90.27, 123/90.31, 90.6

[56] References Cited

U.S. PATENT DOCUMENTS 4,498,352 2/1985 Hedelin ..... 123/90.17
4,658,769 4/1987 Horio et al. ..... 123/90.31
4,715,333 12/1987 Oyaizu ..... 123/90.31
4,716,864 1/1988 Binder ..... 123/90.31
4,726,331 2/1988 Oyaizu ..... 123/90.31
4,741,299 5/1988 Matsuura et al. ..... 123/90.31

FOREIGN PATENT DOCUMENTS 220796 5/1987 European Pat. Off. .
60-164607 8/1985 Japan .

*Primary Examiner*—Charles J. Nyhre
*Assistant Examiner*—Weilun Lo
*Attorney, Agent, or Firm*—Lowe, Price, Leblanc, Becker & Shur

[57] ABSTRACT

A valve drive train for a V-type internal combustion engine is disclosed in which at least one of the cam profiles and/or cam phases of the first and second cam shafts in left or right cylinder bank is diffrent from the other.

6 Claims, 3 Drawing Sheets

VALVE DRIVE TRAIN FOR INTERNAL COMBUSTION ENGINE

BACKGROUND OF THE INVENTION (1) Field of the Invention

The present invention relates to a valve drive train for an internal combustion engine, particularly, for a V-type engine.

(2) Background of the art

A Japanese Patent Application First Publication No. Showa 60-164607 published on Aug. 27, 1985 exemplifies a method for adjusting the tension of a timing belt of an engine.

In a V-type engine in which two (left and right) cylinder banks (rows) are set at an angle, or V to each other and a camshaft is attached on an upper part of each cylinder row (bank). Due to the rotation of the camshafts, intake and exhaust valves installed on the respective cylinders are open and closed. A single timing belt (toothed belt) is wound around each cam pulley (toothed pulley) attached around an axial end of each cam shaft together with a crank pulley (toothed pulley) attached to a crankshaft.

The timing belt is driven in synchronization with the rotation of the engine.

In the above-identified Japanese Patent Application Publication, a cam structure of each cylinder row (bank) having the same phase and the same profile is used as well as each camshaft.

However, the rotation of one or the other of the camshafts is affected by, e.g., vibrations of the timing belt between the respective pulleys, vibrations generated around an axle of the crankshaft in a case where the camshafts of the left and right cylinder rows (banks) are driven by means of a single timing belt. Therefore, errors occur in the opening and closing intervals of the intake and exhaust valves of the respective cylinders along one of the cylinder rows (banks).

Belt tension between the crank pulley and front cam pulley and belt tension between front and rear cam pulleys are different from each other depending on the direction toward which the timing belt is driven to rotate. This creates vibrations of the timing belt as each cam pulley described above, i.e., follows different fluctuations and elongations of the timing belt.

The rotation of the camshaft to which the cam pulley is attached is affected and delayed.

FIG. 1 shows the result of an experiment with a six-cylinder V-type engine having each camshaft of the same profile and same phase. As shown in FIG. 1, the experiment indicates that at one of the cylinder rows (banks) (second, fourth, and sixth cylinders) in which the cam pulley was placed at the front side with respect to the driven direction of the timing belt, the opening timing interval of the intake valve on each cylinder (second, fourth, and sixth cylinders) and closing timing interval of the exhaust valve on each cylinder (second, fourth, and sixth cylinders) were delayed by $\Delta\theta_i$ and $\Delta\theta_e$ with respect to their respective design values $\theta_i$, $\theta_e$.

In this case, the delay quantity $\Delta\theta_e$ of the closing timing interval of the exhaust valve is larger than the delay quantity $\Delta\theta_i$ of the opening timing interval of the intake valve. This is, e.g., because resistance becomes large due to the overlaps of the closing timing intervals of the exhaust valves on one of the cylinder rows (banks) (second, fourth, and sixth cylinders) with the opening timing intervals of the exhaust valves on the other cylinder row (bank) (first, third, and fifth cylinders).

Hence, appropriate opening and closing intervals of the intake and exhaust valves on one or the other of the cylinder rows (banks) and a predetermined valve overlap cannot be achieved so that an engine performance will accordingly be reduced.

SUMMARY OF THE INVENTION

It is therefore an object of the present invention to provide a valve drive train for an internal combustion engine which achieves appropriate opening and closing intervals of intake valves and exhaust valves of respective cylinders of each of left and right cylinder rows (banks) and predetermined valve overlap.

The above-described object can be achieved by providing a valve drive train for an internal combustion engine, comprising: (a) a first cam shaft for actuating at least one of intake and exhaust valves installed on respective cylinders of a first cylinder bank; (b) a second cam shaft for actuating at least one of the intake and exhaust valves installed on respective cylinders of a second cylinder bank, at least one of cam profiles and cam phases provided at the first cam shaft being different from those provided at the second cam shaft; and (c) a valve drive train mechanism having a timing belt and pulleys for transmitting the rotation of an engine crankshaft to the first and second cam shafts via the timing belt and pulleys.

The above-described object can also be achieved by providing a valve drive train for a V-type engine, comprising: (a) a first cam shaft for actuating at least one of intake and exhaust valves installed on respective cylinders of a first cylinder bank; (b) a second cam shaft for actuating at least one of the intake and exhaust valves installed on respective cylinders of a second cylinder bank, cam profiles provided at the first cam shaft being different in a static state from those provided at the second cam shaft so that valve lifts of both cylinder banks are the same in a dynamic state; and (c) a valve drive train mechanism having a timing belt and pulleys for transmitting a rotation of en engine crankshaft to the first and second cam shafts via the timing belt and pulleys.

The above-described object can also be achieved by providing a valve drive train for a V-type engine, comprising: (a) a first cam shaft for actuating at least one of intake and exhaust valves installed on respective cylinders of a first cylinder bank; (b) a second cam shaft for actuating at least one of intake and exhaust valves installed on respective cylinders of a second cylinder bank, cam profiles and/or valve lifts provided at the first cam shaft being different in a static state from those provided at the second cam shaft; and (c) a valve drive train mechanism having a timing belt and pulleys for transmitting the rotation of an engine crankshaft to the first and second cam shafts via the timing belt and pulleys.

DETAILED DESCRIPTION OF THE PREFERRED EMBODIMENT

Reference will hereinafter be made to the drawings in order to facilitate a better understanding of the present invention.

Figure 1:
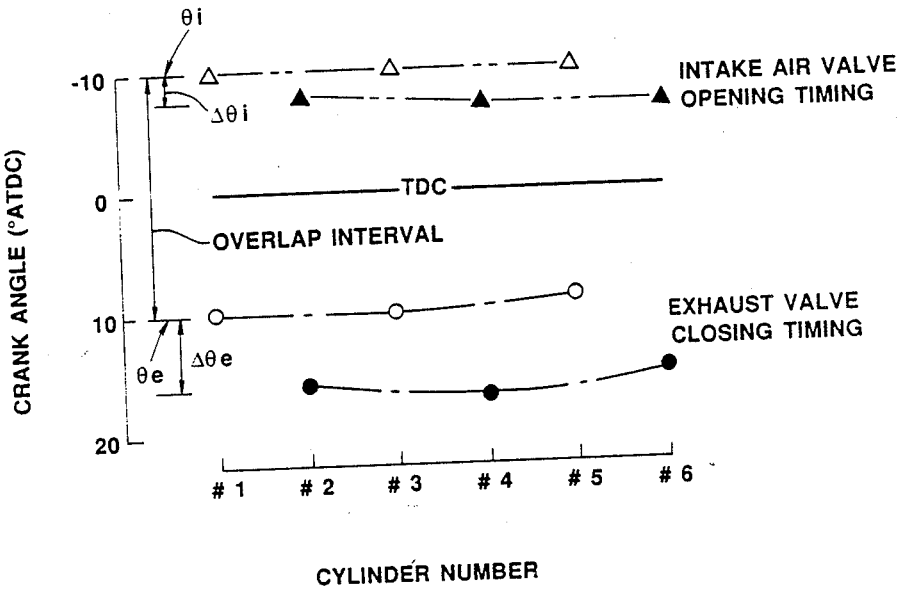
FIG.1 PRIOR ART
FIG. 1 is an experiment data table representing an opening and closing interval of intake and exhaust valves in a six-cylinder V-type engine to which the invention disclosed in a Japanese Patent Application First Publication No. Showa 60-164607 is applied.

FIG. 1 shows plots of an experimental data table of valve opening and closing intervals disclosed in a Japanese Patent Application First Publication No. Showa 60-164607. The experimental data shown in FIG. 1 is already explained in the Background of the art.

Figure 2:
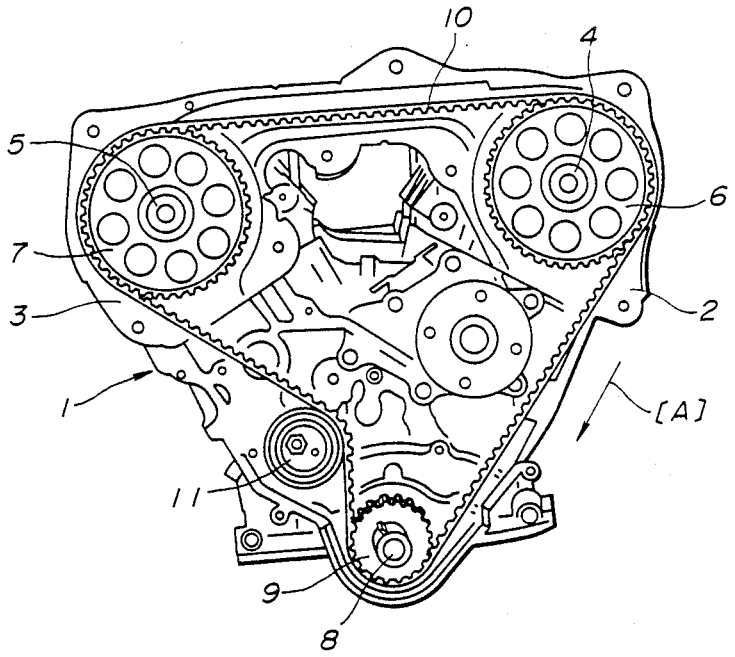
FIG. 2 is a schematic front view of a V-type engine to which the present invention is applicable.
Figure 3:
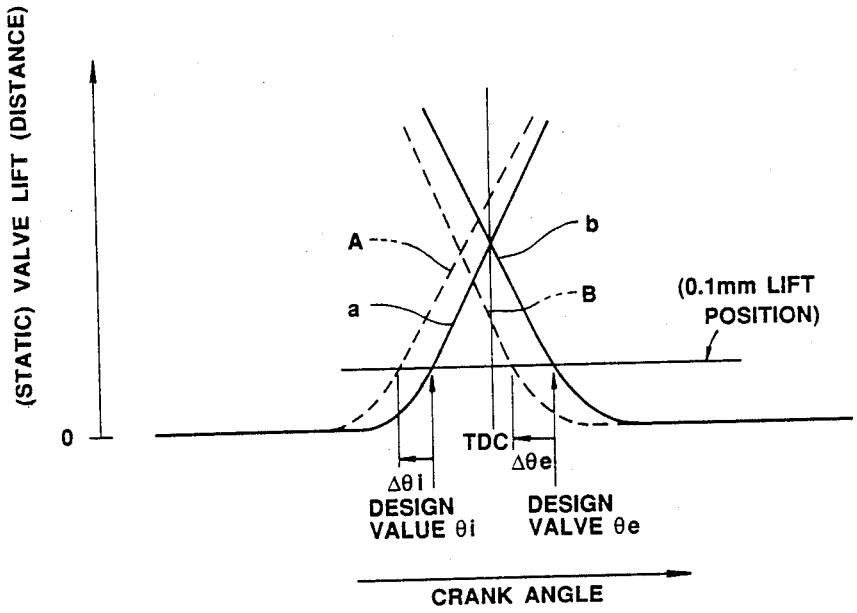
FIG. 3 is a characteristic graph of a cam used in each camshaft in the V-type engine shown in FIG. 2.

FIGS. 2 and 3 show a preferred embodiment of a valve drive train for a V-type engine according to the present invention.

As shown in FIG. 2, a main body 1 of a V-type engine on which first and second cylinder rows (banks) 2 and 3 are arranged at a predetermined angle and two camshafts 4 and 5 are disposed on upper parts of the first and second cylinder rows (banks) 2 and 3.

Cam pulleys 6 and 7 are axially attached to an end of the two camshafts and a single timing belt 10 is wound around the cam pulleys 6 and 7 and a crank pulley 9 axially attached on an end of a crankshaft 8.

The timing belt 10 is rotated in a direction denoted by [A] by means of a crank pulley 9. One of the cam pulleys 6 is defined as a front cam pulley and the other cam pulley 7 is defined as a rear cam pulley, with respect to the direction in which the timing belt 10 is rotated.

A tensioner pulley 11 is disposed between the cam pulley 7 and crank pulley 9 which elastically biases the timing belt 10 from the outside in order to prevent looseness of the timing belt 10.

The camshaft 5 on which the rear cam pulley 7 is placed is formed with cams for the intake and exhaust valves of respective cylinders belonging to the corresponding second cylinder row (bank) 3, the cams having predetermined profiles and predetermined phases as to the order of cylinder strokes. Cams for the intake and exhaust valves for the respective cylinders of a corresponding first cylinder row (bank) are formed on the camshaft 4 of the front cam pulley 6, having different phases with respect to the cams of the above-described camshaft 5 as to the order of the cylinder strokes.

The intake and exhaust cams formed on the camshafts 4 and 5 have characteristics as shown in FIG. 3.

Although the respective profiles are the same, cams (A in FIG. 3) for intake valves placed on the camshaft 4 are formed so as to advance its phase by a predetermined value $\Delta\theta_i$ with respect to the cams (a in FIG. 3) for the intake valves placed on the cam shaft 5. In addition, the cams for exhaust valves placed on the cam shaft 4 (B in FIG. 3) are formed so as to advance its phase by a predetermined value $\Delta\theta_e$ ($\Delta\theta_e > \Delta\theta_i$) with respect to the cams for exhaust valves placed on the cam shaft 5.

It is noted that FIG. 3 illustrates the cam characteristics from the closing intervals of the exhaust valves to the open interval of the intake valves with respect to a top dead center (TDC) position of a piston.

It is also noted that the phases and/or profiles of the cams for intake and exhaust valves placed on the cam shaft 4 may be changed to achieve the characteristics shown in A and B of FIG. 3.

Therefore, in a static state, the phases of the cams placed on the cam shaft 4 of the first cylinder row (bank) 2 are advanced (A and B in FIG. 3). In a dynamic state, i.e., during the engine operation, the phases of the cam shaft 4 become appropriate.

In detail, the cam shaft 4, on which the front cam pulley 6 is placed with respect to the rotational direction of the timing belt 10, is affected by vibrations of the timing belt 10 extended between respective pulleys 6, 7, 9 and by vibrations of the crankshaft 8. Due to this influence, the rotation becomes delayed. Since the phases of cams placed on the cam shaft 4 are advanced by predetermined values $\Delta\theta_i$ and $\Delta\theta_e$, the opening and closing intervals of the respective cylinders in the corresponding cylinder row (bank) 2 are not delayed with respect to the described retardation of the rotation of the cam shaft 4. Therefore, the intake and exhaust valves will be opened and closed at a predetermined timing.

Hence, in the same way as the intake and exhaust valves for the respective cylinders of the second cylinder row (bank) 3 driven by means of the other cam shaft 5, the appropriate opening and closing intervals of the intake and exhaust valves of the first cylinder row (bank) 2 and appropriate valve overlap can be achieved. Consequently, the engine performance can largely be improved without variations of output powers generated by the left and/or right cylinder rows (banks) 2 and 3.

As described hereinabove, since in the valve train for the V-type engine according to the present invention at least one of phases and/or profiles of cams formed on the cam shaft of the first cylinder row (bank) and that on the second cam shaft is different, the intake and exhaust valves can be opened and closed at the appropriate timings in the same way as the intake and exhaust valves of the other cylinder row (bank) with respect to the retardation of rotation of one cam shaft due to the vibrations of the crank shaft and timing belt. Hence, a stable output in the respective cylinder rows (banks) can be achieved and as well as improved engine performace can be achieved.

It will fully be appreciated by those skilled in the art that the foregoing description has been made in terms of the preferred embodiment and various changes and modifications may be made without departing from the scope of the invention, which is to be defined by the appended claims.

What is claimed is:

1. A valve drive train for an internal combustion engine having a crankshaft, comprising:

(a) a first cam shaft for actuating both the intake and exhaust valves installed on respective cylinders of a first cylinder bank;

(b) a second cam shaft for actuating both the intake and exhaust valves installed on respective cylinders of a second cylinder bank, cam profiles and cam phases with respect to the crankshaft provided on the first cam shaft being different from those provided on the second cam shaft when the engine is stopped; and (c) a valve drive train mechanism having a single timing belt and pulleys for transmitting a rotation of an engine crankshaft to the first and second cam shafts via the timing belt and pulleys.

2. A valve drive train for a V-type engine having a crankshaft, comprising:

(a) a first cam shaft for actuating intake and exhaust valves installed on respective cylinders of a first cylinder bank;

(b) a second cam shaft for actuating intake and exhaust valves installed on respective cylinders of a second cylinder bank, cam profiles provided on the first cam shaft being different in a static state from those provided on the second cam shaft so that the timing of maximum valve lifts on both cylinder banks with respect to the crankshaft are the same in a dynamic state; and (c) a valve drive train mechanism, having a single timing belt and pulleys, for transmitting a rotation of an engine crankshaft to the first and second cam shafts via the timing belt and pulleys.

3. A valve drive train for a V-type engine having a crankshaft, comprising:

(a) a first cam shaft for actuating intake and exhaust valves installed on respective cylinders of a first cylinder bank;

(b) a second cam shaft for actuating intake and exhaust valves installed on respective cylinders of a second cylinder bank, cam profiles and maximum valve lift timing provided on the first cam shaft being different in a static state with respect to the crankshaft from those provided on the second cam shaft; and (c) a valve drive train mechanism having a single timing belt and pulleys for transmitting a rotation of an engine crankshaft to the first and second cam shafts via the timing belt and pulleys.

4. A valve drive train for a V-type engine as set forth in claim 3, wherein the cam profiles provided on the first cam shaft are advanced by predetermined crank angle values with respect to those provided on the second cam shaft, the first cam shaft being placed in the first cylinder bank which is to the rear with respect to the rotation direction of the timing belt.

5. A valve drive train for a V-type engine as set forth in claim 3, wherein the cam phases provided on the first cam shaft are advanced by predetermined crank angle values than those provided on the second cam shaft, the first cam shaft being placed in the first cylinder bank which is to the rear with respect to the rotation direction of the timing belt.

6. A valve drive train for a V-type engine as set forth in claim 5, wherein the predetermined crank angles are $\Delta\theta_i$ and $\Delta\theta_e$ in terms of intake valve opening interval and exhaust valve opening interval which correspond to deviations from designed values in the dynamic state when the phases of both the first and second cam shafts are the same.

* * * * *